US005566952A

United States Patent [19]

Mullin et al.

[11] Patent Number: 5,566,952

[45] Date of Patent: Oct. 22, 1996

[54] FOLDABLE SPORTS GOAL STRUCTURE

[75] Inventors: Carol Mullin; James Mullin, both of Redwood City, Calif.

[73] Assignee: Moving Target Sports, Inc., Belmont, Calif.

[21] Appl. No.: 590,839

[22] Filed: Jan. 24, 1996

[51] Int. Cl.[6] ..... A63B 63/04

[52] U.S. Cl. ..... 273/400

[58] Field of Search ..... 273/400

[56] References Cited

U.S. PATENT DOCUMENTS

| | | | |
|---|---|---|---|
| 4,083,561 | 4/1978 | Daffer, Jr. | 273/103 |
| 4,420,158 | 12/1983 | Klock et al. | 273/400 |
| 5,080,375 | 11/1992 | Moosavi | 273/400 |
| 5,186,469 | 2/1993 | Terris | 273/400 |
| 5,244,213 | 9/1993 | Armell | 273/400 |
| 5,273,292 | 12/1993 | Pardi et al. | 273/400 |
| 5,351,948 | 10/1994 | Thomas | 273/26 A |
| 5,372,368 | 12/1994 | Pavonetti | 273/411 |
| 5,407,211 | 4/1995 | Bottiglieri | 273/400 |
| 5,413,340 | 5/1995 | Potvin et al. | 273/127 |
| 5,413,356 | 5/1995 | Bigelow | 273/400 |
| 5,421,586 | 6/1995 | Amram et al. | 273/400 |
| 5,427,381 | 6/1995 | Macaluso et al. | 273/400 |
| 5,431,411 | 7/1995 | Padilla | 273/400 |

*Primary Examiner*—William H. Grieb
*Attorney, Agent, or Firm*—Limbach & Limbach L.L.P.

[57] ABSTRACT

A foldable sports goal structure includes a horizontal crossbar member supported at each end by vertically extending posts. A pair of tubular shaped first support members rearwardly extend from the lower ends of the posts, and a pair of tubular shaped second support members have front ends that fit into and extend rearwardly from the rear ends of the first support members. A pivot member rotatably connects the front and rear ends together. The first supporting member has a circular aperture on a side surface thereof that is formed continuously with a slot that extends to and terminates at the rear end of the first support member. The slot has a width that is smaller than the diameter of the second support member and the circular aperture has a diameter substantially equal to the diameter of the second support member. The second support member travels through the slot and into the circular aperture when the second support member is rotated about the pivot member.

32 Claims, 14 Drawing Sheets

FOLDABLE SPORTS GOAL STRUCTURE

FIELD OF THE INVENTION

The present invention relates to a sports goal structure, and more particularly to a portable sports goal structure which folds up for convenient storage and transportation.

BACKGROUND OF THE INVENTION

Recreational sports of all types have become increasingly popular over the past several years. In particular, soccer, street hockey and most recently roller hockey have shown tremendous growth and potential in the United States. With the formation of the Roller Hockey International league, it appears that roller, street and ice hockey are becoming more popular and being played at all levels. Roller hockey youth and adult leagues, as well as pickup games of all ages, are emerging in most cities. Because roller hockey provides the fast pace of ice hockey, but does not require the playing surface of ice, this sport can be played almost anywhere. Soccer has also become increasingly popular since the World Cup was held in the United States. Frequently games are played without goalies so a goal significantly smaller than the regulation size is required.

Sports goal structures have been developed for street hockey players, as well as soccer players who desire a smaller size goal opening when playing short sided (without a goalie). These sports goal structures are typically stored in the home, and taken to the playing field or site by one of the players. For roller hockey, the sports goal structure is often carried by one of the skaters as they skate to the playing site. Often, the numbers of players in such soccer and hockey games can vary, such that the players may alternate between using a goalie and playing with an open net.

In view of the foregoing, there has arisen a need for a sports goal structure which can be easily transported to a playing site that allows for easy set-up and tear down, as well as a sports goal structure where the players can easily adjust the goal size. A number of portable sports goal structures have been developed, for example, those described in U.S. Pat. Nos. 5,080,375, 5,431,411, 5,186,469, 5,427,381, 5,421,586 and 5,244,213. However, each of these goal designs has certain drawbacks. For example, the goals described in U.S. Pat. Nos. 5,080,375 and 5,421,586 both fail to quickly disassemble for easy storage and to enable a player to easily carry the goals to and from playing sites. Further, disassembly of these goals can also lead to the net falling off the sides of the structure, increasing subsequent setup time. The goals described in U.S. Pat. Nos. 5,427,381 and 5,244,213 both have curved shapes instead of the more standard regulation rectangular shape for all sports goal structures. The goals illustrated in U.S. Pat. Nos. 5,431,411 and 5,186,469 are prone to breakage and excessive manufacturing costs due to the large number of interconnecting parts.

There is a need for an inexpensive, foldably portable, sturdy, simply designed sports goal structure that quickly and easily sets ups and folds down for easy use, transportation and storage. There is also a need for such a sports goal structure to have dimensions that are easily adjustable.

SUMMARY OF THE INVENTION

Therefore, it is an object of this invention to provide an improved, inexpensive, and light weight sports goal structure constructed for easy setup, transportation and storage.

A further object is to provide such a sports goal structure that folds into a planar configuration and is then easily stored or transported.

A further object is to provide a sports goal structure with all structural members made of pipe, including a folding joint.

A further object is to provide a means of making the goal smaller before folding for easy transportation or storage.

A still further object is to provide a detachable means of supporting the main structure to strengthen the folding joint.

The aforementioned objects are addressed by the sports goal structure of the present invention, which includes a U-shaped goal frame having a horizontal crossbar member supported at each end by vertically extending posts. The goal frame forms an upright rectangular goal opening when the lower ends of the posts are placed on a playing surface.

A support frame includes a pair of tubular shaped first support members, each rearwardly extending from the lower ends of each of the posts, and a pair of tubular shaped second support members, each having a front end with an outer diameter dimensioned so that each of the front ends is fittable within each of the rear ends. Each of the first supporting members has a shaped cut-out in a surface thereof. The cut-out is shaped to permit rotation of the second support members from a first position through the shaped cut-out to a second position. In the first position, each of the front ends of the second support members are fitted within the inner diameter of each of the rear ends of the first support members so that they extend linearly and rearwardly from the rear ends. In the second position, the second support member extends substantially perpendicular to the first support member through the shaped cut-out. A pivot member rotatably connects the first support member to the second support member and permits the rotation between the first and second positions.

A net means attaches to the goal frame and the support frame.

When the goal structure is in the first position, first and second support members support the U-shaped goal frame in its vertical position. When the goal structure is in its second position, second support members are folded up so that the goal structure is in a folded planer configuration for easy transportation and storage.

Other objects and features of the present invention will become apparent by a review of the specification, claims and appended figures.

DETAILED DESCRIPTION OF THE PREFERRED EMBODIMENTS

Figure 1:
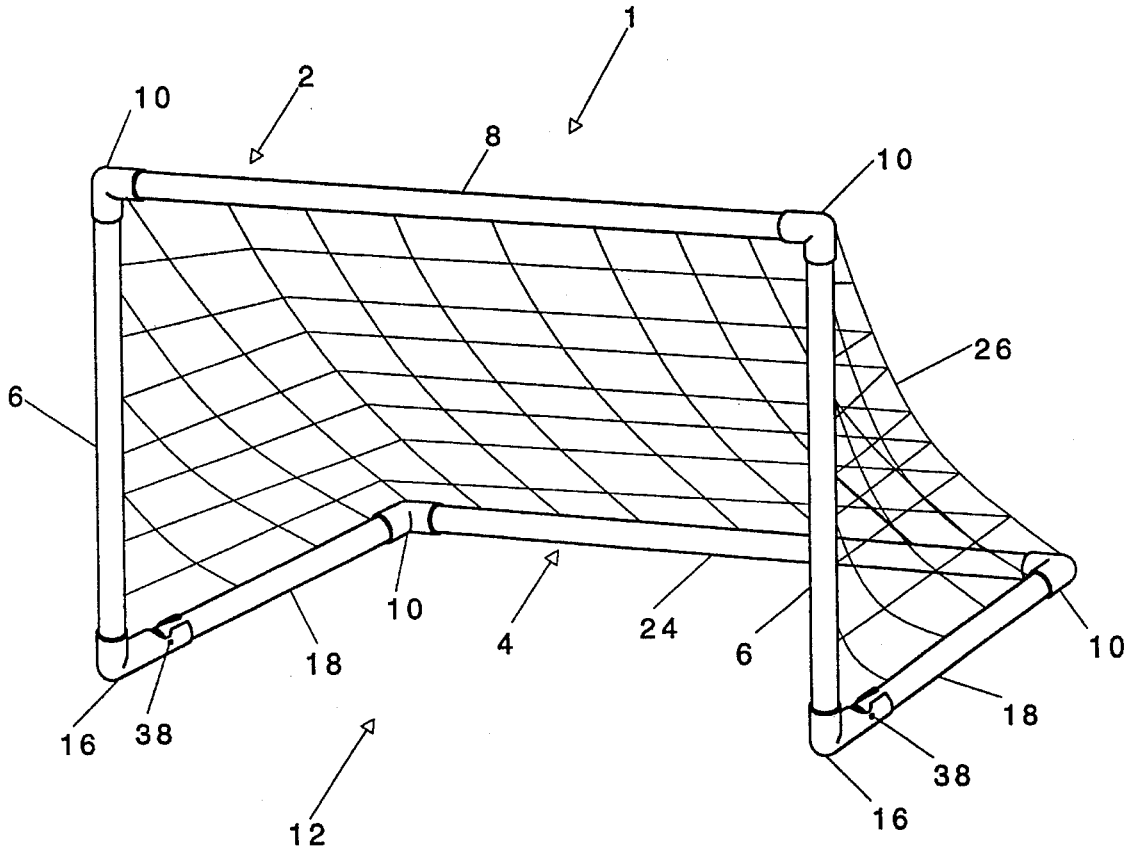
FIG. 1 is a perspective view of the foldable sports goal structure of the present invention.

Referring to the drawings, FIG. 1 illustrates the goal structure 1 of the present invention, which includes a U-shaped goal frame assembly 2 and a support frame assembly 4.

The U-shaped goal frame assembly 2 includes two vertically oriented posts 6 and a crossbar member 8. Crossbar member 8 is attached to the top ends of posts 6 with comer joints 10. When goal frame 2 is positioned on the ground, it forms a goal opening 12.

The support frame assembly 4 supports the goal frame 2 in a vertical position, and includes two sets of first and second support members 16 and 18. Each first support member 16 is an elbow joint attached to the bottom end of the post 6 forming a right angle. First and second support members 16 and 18 are connected together and form a rotatable joint (described in further detail below). A support cross-member 24 is attached between the back ends of the second support members 18 using comer joints 10.

Corner joints 10 can be connected to posts 6, crossbar member 8, second support members 18 and/or support cross-member 24 either by a press fit, glue or being screwed together.

A puck or ball stopping net 26 is attached along the goal frame 2 and the support frame assembly 4. The net is attached either by weaving the net's mesh over the goal frame 2 and the support frame 4, or by using strings, tape, hook and tab connectors (under the tradename Velcro), a sleeve inserted over frames ¾, etc. (not shown).

Figure 2:
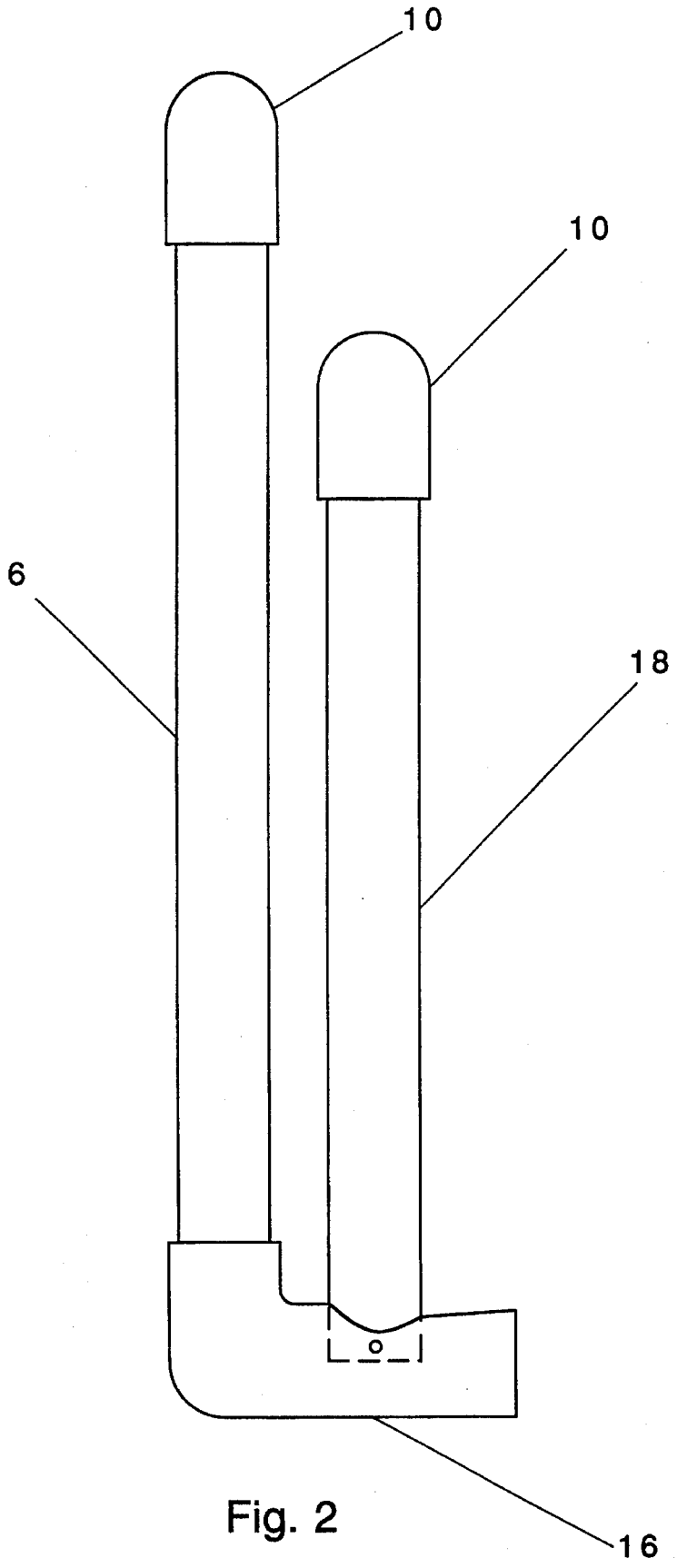
FIG. 2 is a side view of the sports goal structure in its folded position.

The first support members 16 allow the goal structure 1 to fold up from an open playing position, illustrated in FIG. 1, into a flat folded closed position, illustrated in FIG. 2, for easy handling and storage.

Figure 3A:
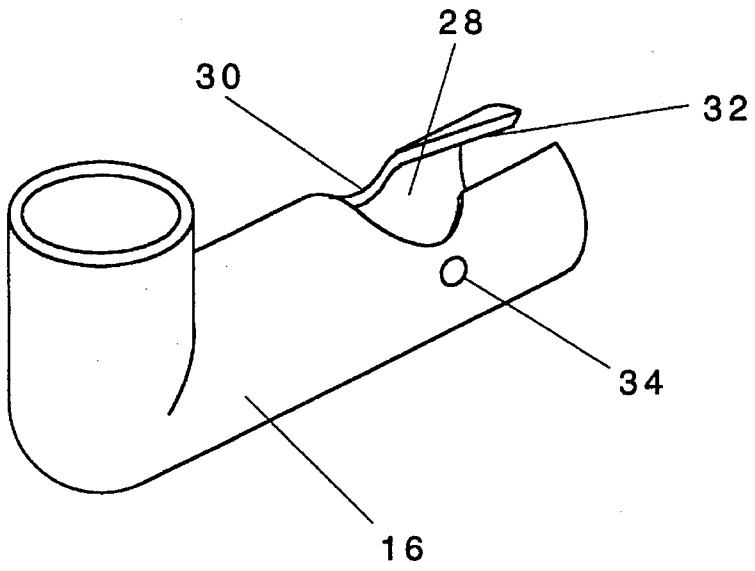
FIG. 3*a* is a perspective view of the folding joint used in the present invention.
Figure 3B:
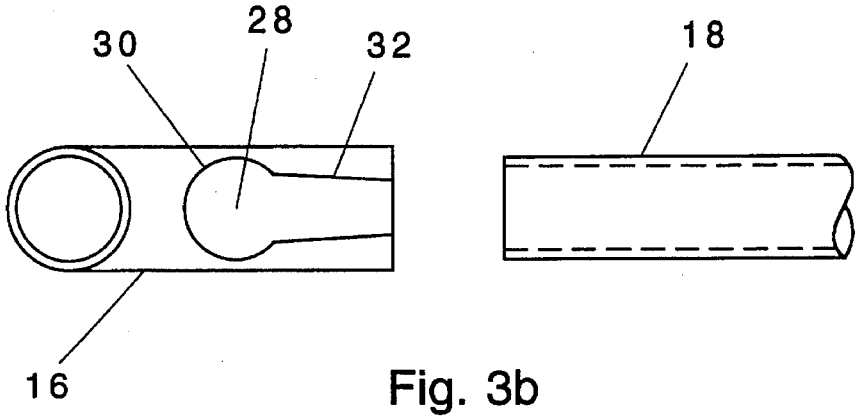
FIG. 3*b* is an exploded top view of the folding joint used in the present invention.
Figure 3C:
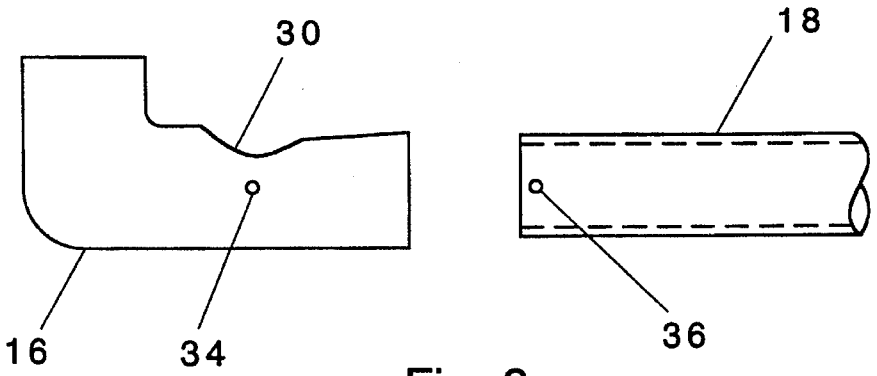
FIG. 3*c* is an exploded side view of the folding joint used in the present invention.
Figure 4A:
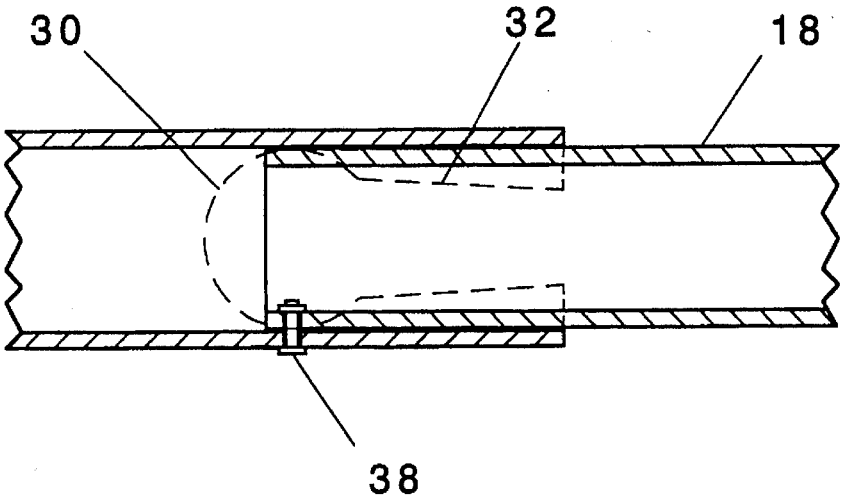
FIG. 4*a* is a top cross-sectional view of the folded joint in the open position.
Figure 4B:
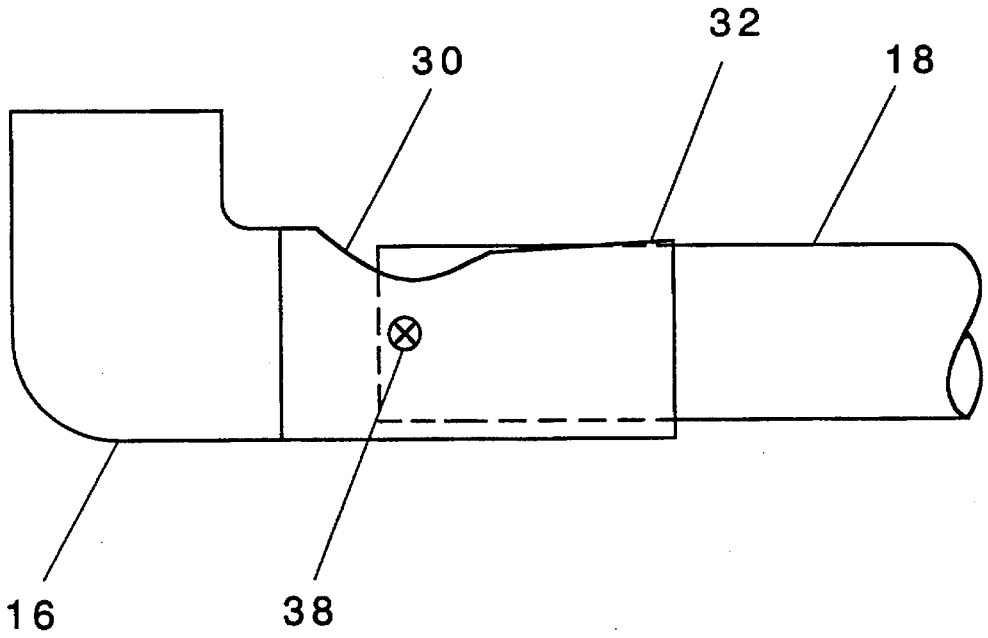
FIG. 4*b* is a side view of the folding joint in the open position.

The first support member 16 is illustrated in FIGS. 3*a*–3*c*. Each first support member 16 has a shaped cutout 28 on its top side. Cutout 28 includes a circular aperture 30 continuous with a slot 32 that extends to and terminates at the rear end of the first support member 16. Second support member 18 has a smaller outer diameter than the inner diameter of first support member 16, and inserts by its front end into the rear end of first support member 16 until holes 34 and 36 of first and second support members 16/18 respectively overlap each other, as illustrated in FIG. 4*b*. A pivot member 38, such as a bolt, is secured through holes 34 and 36 for rotatably securing the first and second support members 16/18 together about a pivot point defined by holes 34/36, as illustrated in FIG. 4*a*. The slot 32 has a width that is smaller than the outer diameter of the second support member 18, and the circular aperture 30 has a diameter approximately the same as the outer diameter of the second support member 18.

Figure 5A:
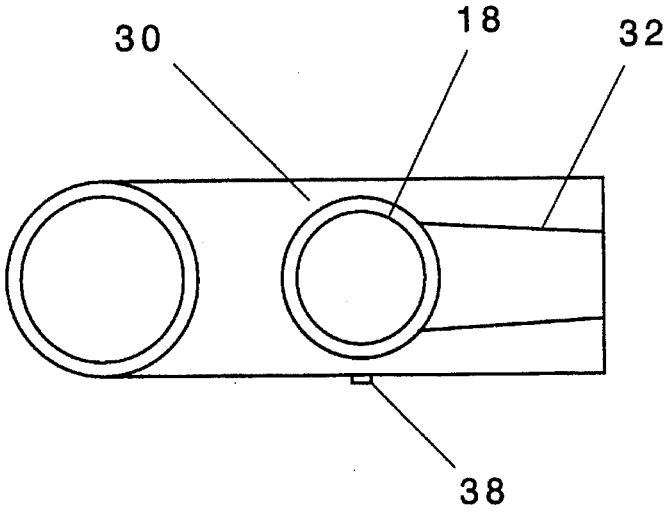
FIG. 5*a* is a top view of the folding joint in the folded position.
Figure 5B:
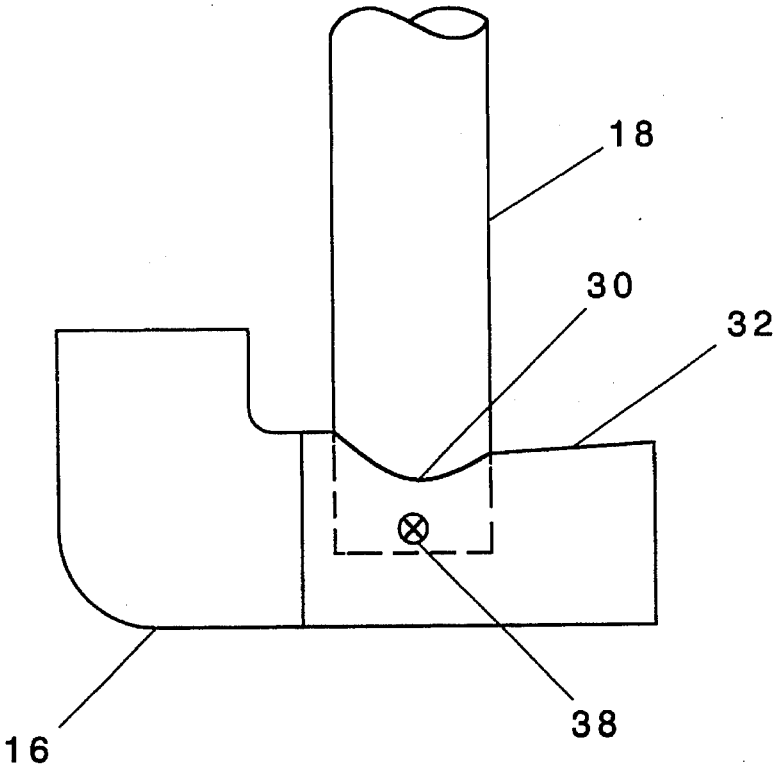
FIG. 5*b* is a side view of the folding joint in the folded position.

FIGS. 4*a*–4*b* illustrate the rotatable joint when the goal structure 1 is in its open position, and first and second support members 16/18 are parallel. To fold the goal structure 1 into the folded position, second support member 18 is rotated about pivot member 38, such that support member 18 is pushed through the slot 32 until it snaps into the circular aperture 30, as illustrated in FIGS. 5*a*–5*b*. To open the goal structure 1 back up again, second support member 18 is rotated back through the slot 32 until it snaps back into first support member 16.

In its open/unfolded position, goal structure 1 alternately provides two different goal openings for the player's use. Goal opening 12 is formed when posts 6 are vertically oriented and support frame 4 is placed flat on the ground. Goal structure 1 can be tipped over to form a second goal opening by vertically orienting the first and second support members and placing goal frame 2 flat on the ground. This second goal opening, defined by the first and second support members 16/18 and cross-member 24, will have the same width as goal opening 12. However, if the overall length of the first and second support members differs from the length of posts 6, then the second goal opening will have a different height than the first goal opening. Therefore, two different goal openings with two different heights are available to choose from, wherein the first and second goal openings are formed by the goal frame assembly 2 and the support structure 4 respectively.

The first support member 16 uses its natural shape and flexibility as part of the locking mechanism such that the second support member 18 snaps into and out of the shaped cutout 28 to secure the goal structure 1 in either its open or closed position. Once the goal structure 1 is locked in its closed/folded position, one can easily carry the goal structure 1 with a single hand by grasping the crossbar 8 or the support cross-member 24. Further, the first support member 16 provides a flat surface so the goal structure 1 will stand vertically in its closed position.

Figure 6A:
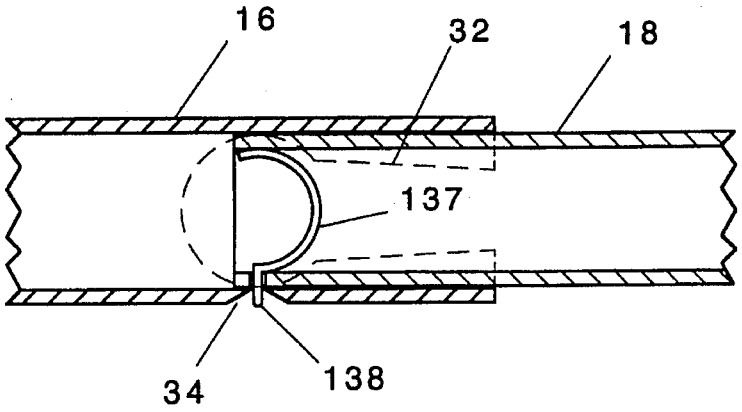
FIG. 6*a* is a top cross-sectional view of the folding joint showing a biased pivot member.
Figure 6B:
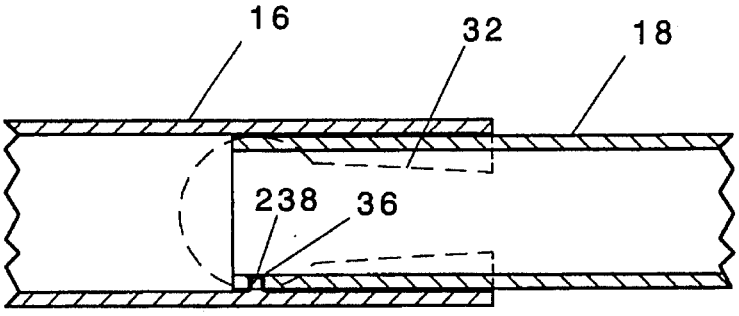
FIGS. 6*b*–6*c* are top cross-sectional views of the folding joint showing a protrusion as the pivot member.
Figure 6C:
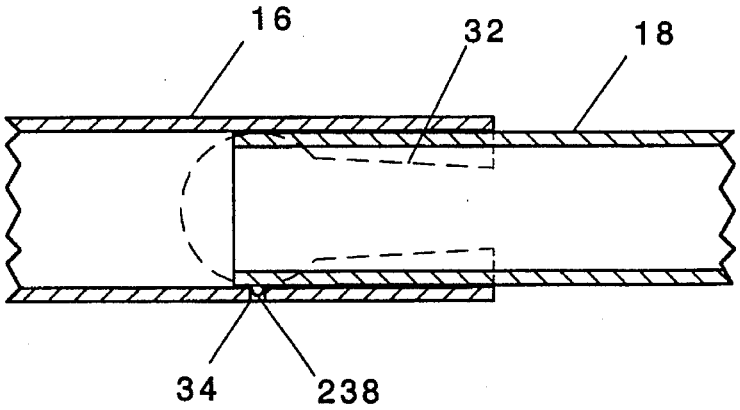
Figure 6D:
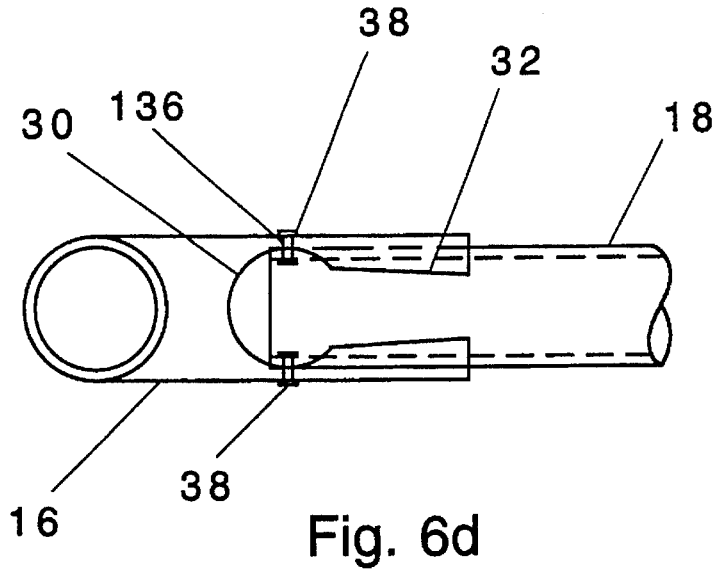
FIG. 6*d* is a top view of the folding joint with two pivot members.

FIGS. 6*a*–6*d* illustrate different embodiments of the pivot member 38. Instead of a bolt, a spring loaded button 138 can be used to secure first and second support members 16/18 together about the pivot point, as illustrated in FIG. 6*a*. A metallic U-shaped spring member 137 biases button 138 to protrude through holes 34/36. By pressing in button 138, the second support member 18 can be easily disassembled and reassembled with first support member 16. Alternately, the pivot member can be a knob or protrusion 238 formed on either the first or second support members 16/18 that protrudes through hole 34 or 36 formed in the other of the first or second support members 16/18, as illustrated in FIGS. 6*b* and 6*c*. Lastly, a second pivot member 38 can be used with a second set of holes 134/136, as illustrated in FIG. 6*d*. The dual pivot member design strengthens the folding joint 22, but is more difficult and expensive to manufacture. The second pivot member is only necessary on larger goal assemblies that require an additionally strengthened pivot point between the first and second support members 16/18.

The first and second support members 16/18 that form the rotatable joint are ideal because they employ a pipe-to-pipe connection that requires only a single additional element, the pivot member 38, to releasably lock the sports goal structure 1 in the folded and open positions. The shaped cut-out 28 and holes 34/36 are simple to machine into the first and second support members. Further, the first support member 16 can be formed by injection molding, wherein the only machining required is drilling hole 36 in second support member 18. Slot 32 provides a simple releasable means of locking the goal structure 1 in its open position and circular aperture 30 provides a simple releasable means for locking the goal structure 1 in its closed/folded position.

Figure 7A:
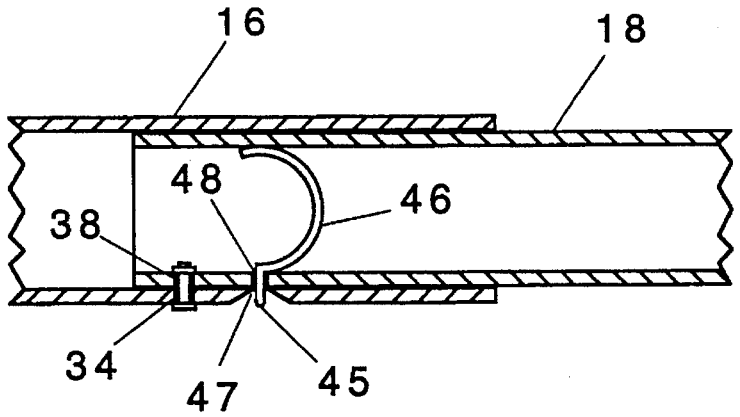
FIG. 7*a* is a top cross-sectional view of the folding joint with a locking button.
Figure 7B:
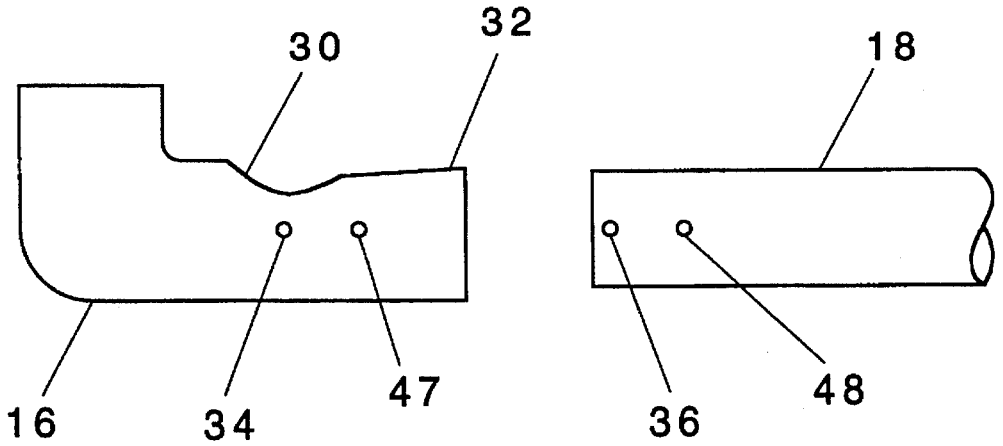
FIG. 7*b* is an exploded side view of the folding joint with two sets of holes for locking the folding joint.

FIGS. 7*a*–7*b* illustrate an alternate embodiment of the present invention, where the second support member 18 includes a U-shaped spring member 46 which terminates in a button 45 that is biased to protrude through a second set of holes 47/48 to lock the second support member 18 in the game playing position. When the button is pressed in, the second support member 18 is unlocked and the goal structure 1 can then be folded. A thumb screw, or bolt could be used instead of the spring loaded button 45, but it would not be as convenient.

Figure 8:
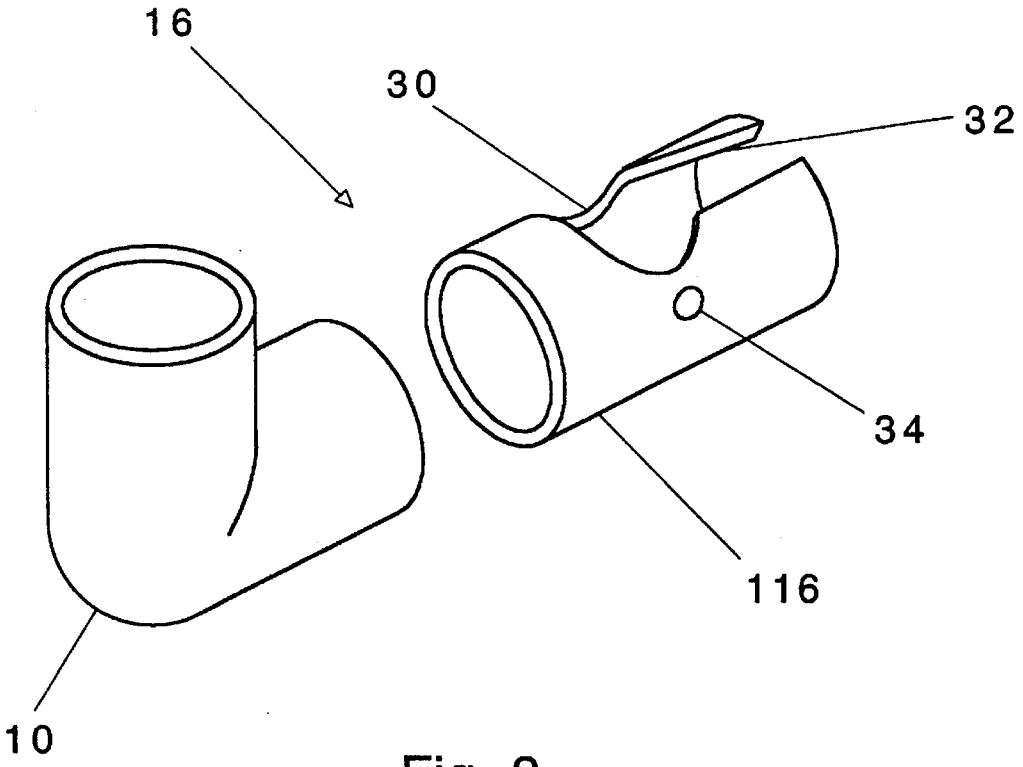
FIG. 8 is an exploded perspective view of the folding joint and the comer piece as two separate pieces.

FIG. 8 illustrates a second alternate embodiment of the first support member, where the first support members 16 comprise two parts: a corner joint 10 connecting to the post 6, and a linear tube 116 with the cut-out portion 28 therein that constitutes the first support member 16. The advantage to this embodiment is that the corner joints 10 are used throughout the goal structure 1, and by using a standard part, manufacturing costs can be reduced.

Figure 9:
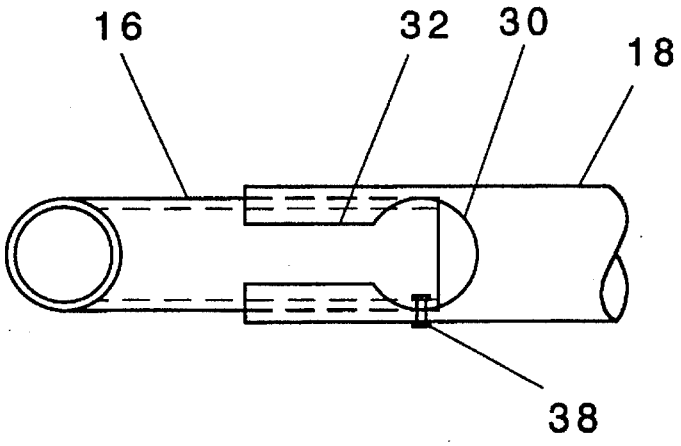
FIG. 9 is a top view of the folding joint where the cut-out portion is formed in the second support member.

FIG. 9 illustrates a second alternate embodiment of the present invention, where the first supporting member 16 inserts into the second supporting member 18, and the aperture 30 and slot 32 are formed in the second supporting member 18. This embodiment illustrates that it is not critical which of the first and second support members 16/18 has the larger inside diameter and the cut-out portion 28.

Figure 10:
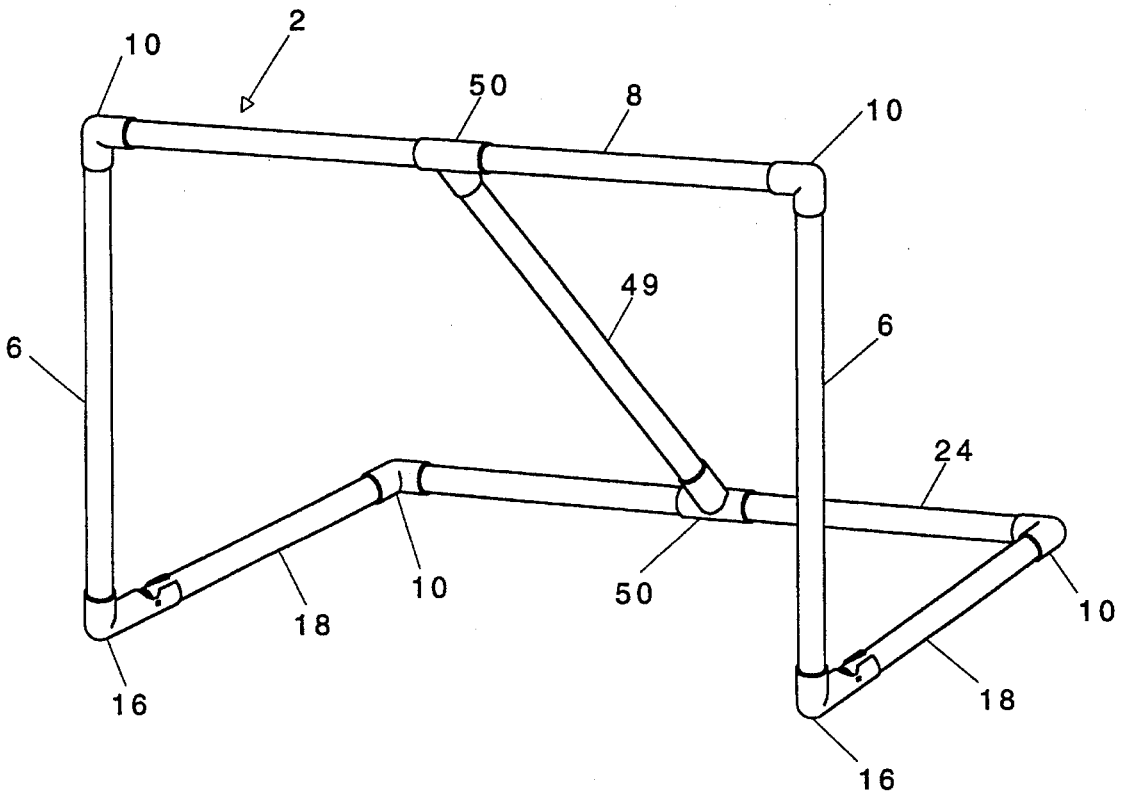
FIG. 10 is a perspective view of the foldable goal with a removable angled back support.

FIG. 10 illustrates a third alternate embodiment of the present invention, where an angled support member 49 is attached to crossbar member 8 and cross-member 24 via "T" shaped connectors 50. Support member 49 prevents the goal structure 1 from folding out of its game playing position when, during use, the force of a player or ball exerts a backward pressure on posts 6 or crossbar member 8. Support member 49 pops out of T-shaped connectors 50 so that goal structure 1 can be folded into its closed position. Support member 49 provides additional structural support as well as serving as a locking mechanism for the sports goal structure 1.

Figure 11A:
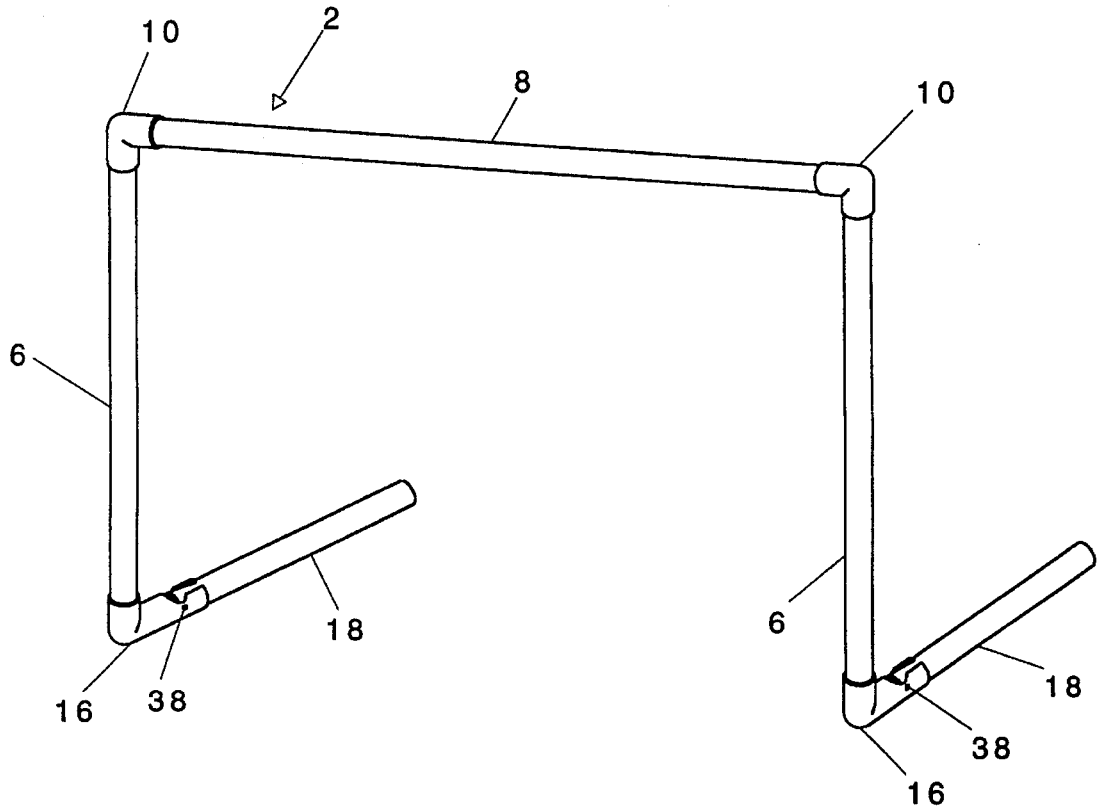
FIG. 11*a* is a perspective view of the foldable goal without a back supporting cross-member.
Figure 11B:
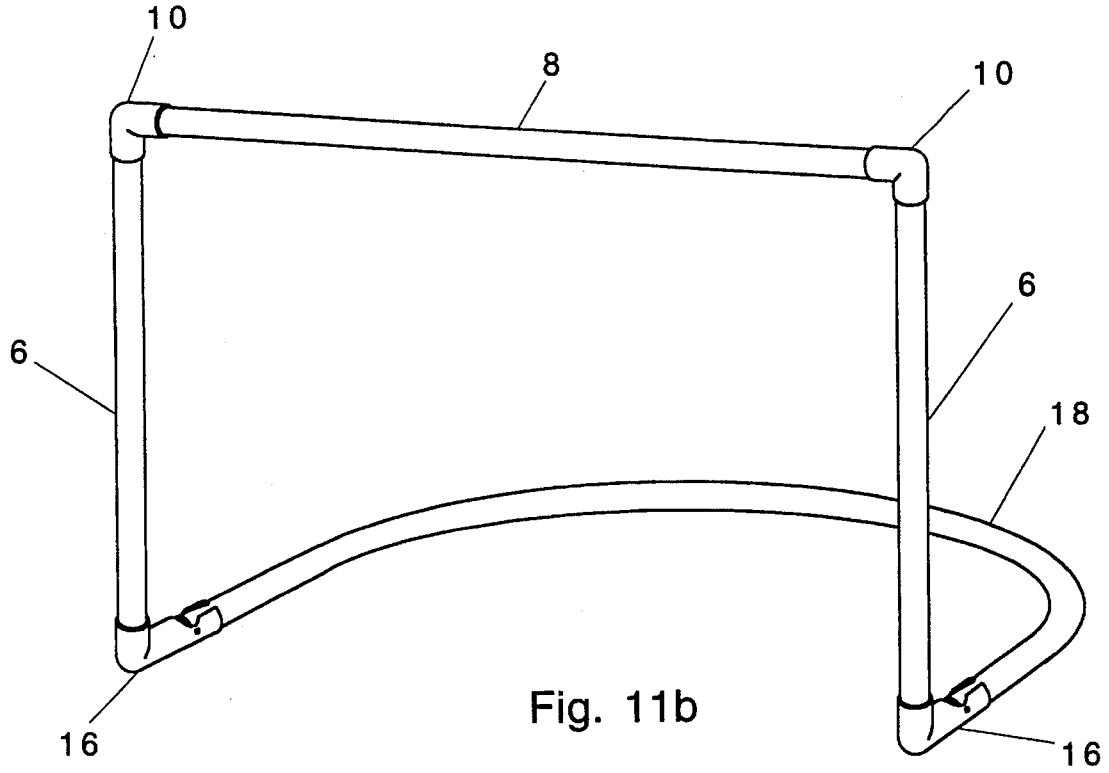
FIG. 11*b* is a perspective view of the foldable goal with an arcuately shaped back supporting frame.
Figure 11C:
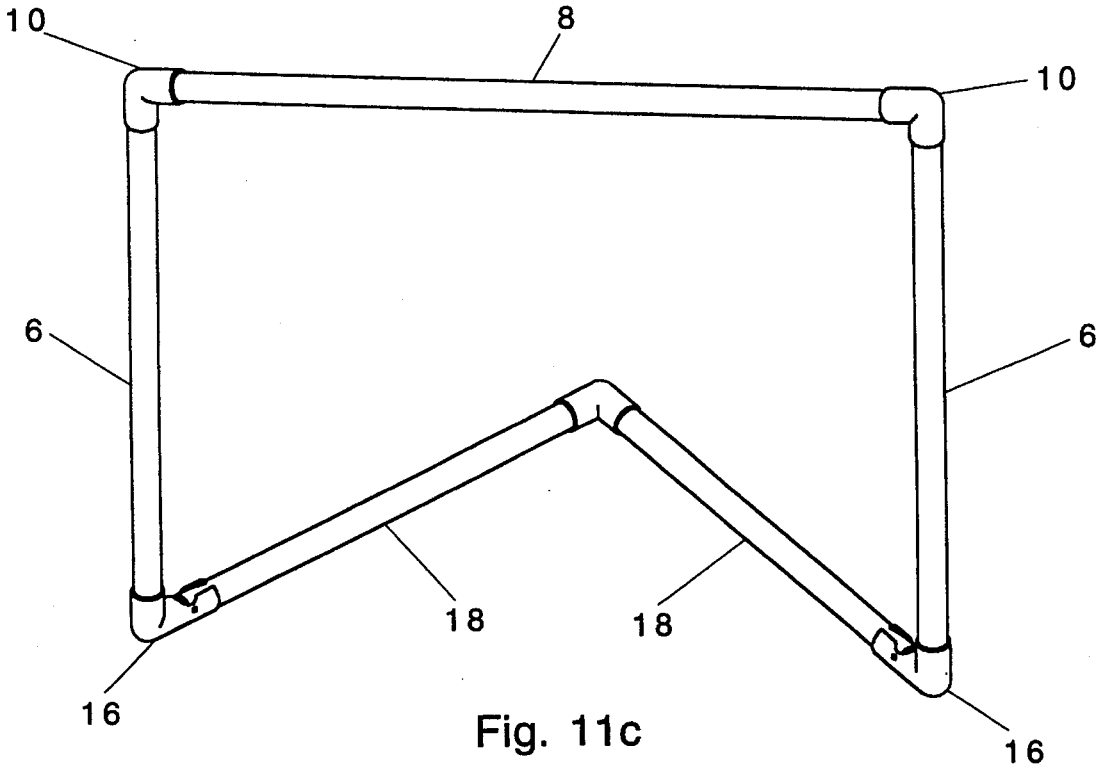
FIG. 11*c* is a perspective view of the foldable goal with second support members extending to a single point.

FIGS. 11*a*–11*c* illustrate different alternate embodiments of the support frame assembly 4. FIG. 11*a* illustrates support frame assembly 4 with no support cross-member 24 connected between second support members 18. Each second support member 18 independently rotates about pivot member 38. While this embodiment contains fewer parts, it may not be as stable as the embodiments described above, since the support cross member 24 and corner joints 10 provide weight to the support frame 4 that prevents the goal frame 2 from falling forward if hit from behind. Therefore, second support members 18 of this embodiment may be filled with a heavy material, such as sand etc, to provide weight to maintain the goal frame 2 in a vertical position. FIG. 11*b* illustrates a single arcuately shaped second support member 18 that engages the first support members 16 at each of its ends to support goal frame 1 in its vertical position. FIG. 11*c* illustrates second support members 18 extending rearwardly at an angle such that the rear ends of second support members 18 are attached or formed integrally together at a point.

Figure 12A:
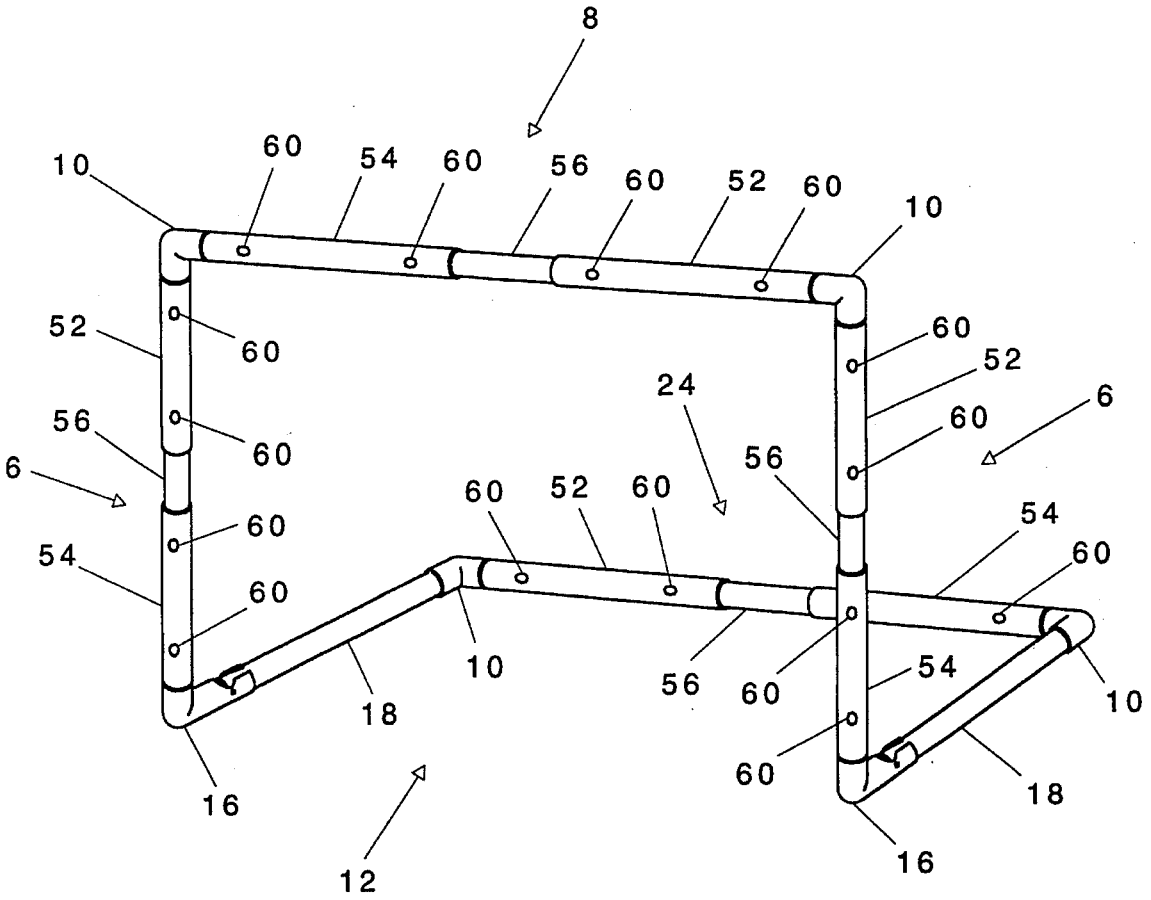
FIG. 12*a* is a perspective view of the foldable goal with telescoping posts, crossbar and cross-member for adjusting the size of the goal.
Figure 12B:
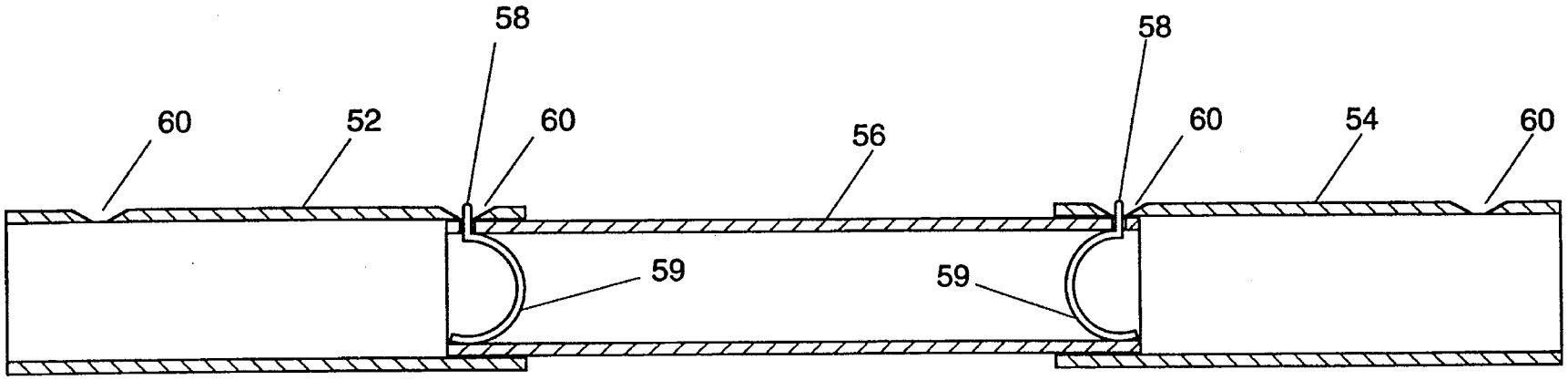
FIG. 12*b* is a side cross-sectional view of one of the telescoping posts, crossbar and cross-members.

FIGS. 12*a*–12*b* illustrate a fourth alternate embodiment, where the posts 6, crossbar 8, and cross-member 24 are each formed of telescoping tubular members 52 and 54 that slidably overlap member 56. Spring loaded buttons 58 formed on the ends of U-shaped spring members 59 protrude from member 56 into holes 60 formed in members 52 and 54. By pushing in button 58, members 52/54 slide relative to member 56 until buttons 58 engage other holes 60 resulting in different overall lengths of posts 6, crossbar 8 and/or cross-member 24. The different overall lengths form goal openings 12 having different dimensions in height and/or width. While members 52 and 54 are illustrated as overlapping member 56, this configuration can be inverted so that members 52 and 54 slide inside of member 56. Angled support member 48 can also be used with this telescoping embodiment and would also be formed of telescoping members 52/54 overlapping member 56. This telescoping embodiment allows the user to quickly change the dimensions of both/either the height and width of the goal opening 12 to customize the goal structure 1 for various uses. For example, the goal opening 12 could be reduced in size if no goalie is desired during street hockey, or expanded if a goalie is used, or expanded further if the sports goal structure 1 is used for soccer instead of street hockey, etc. After use, the sports goal structure 1 can be collapsed down to its smallest dimensions, and then folded into its closed position for easy transportation and storage.

Figure 13A:
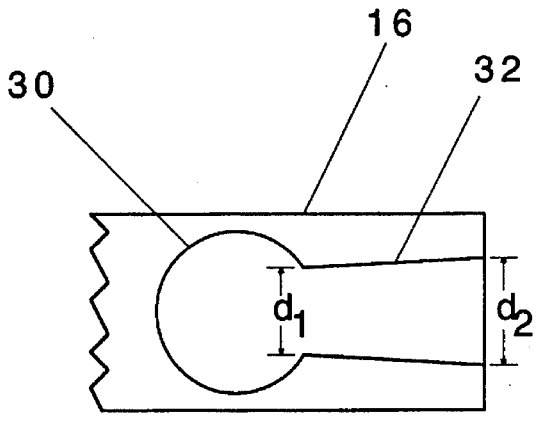
FIGS. 13*a*–13*b* are top views of the first supporting member illustrating the slot having varying widths.
Figure 13B:
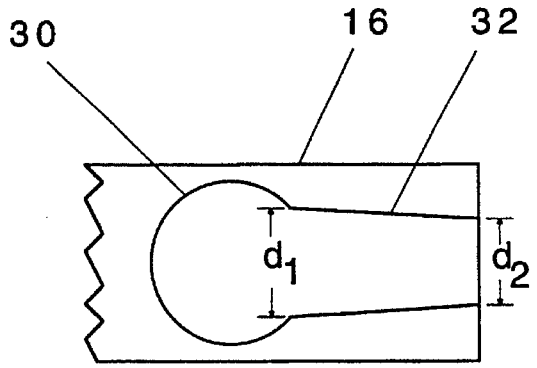

FIGS. 13*a*–*b* illustrate a fifth alternate embodiment, where the width of the slot 32 varies over its length to selectively provide different relative locking forces for either the folded or unfolded positions of the goal structure 1. The width of the slot 32 is $d_1$ where it meets the circular aperture 30, and $d_2$ where it meets the end of first support member 16. By making $d_1$ smaller than $d_2$ (FIG. 13*a*), the locking force of the goal structure 1 is relatively increased in its folded position and relatively decreased in its unfolded/open position. By making $d_1$ larger than $d_2$ (FIG. 13*a*), the locking force of the goal structure 1 is relatively increased in its unfolded/open position and relatively decreased in its folded position. The varying slot width is optimized to provide the ideal locking forces for the goal structure 1 in both of its folded and unfolded positions.

Figure 14:
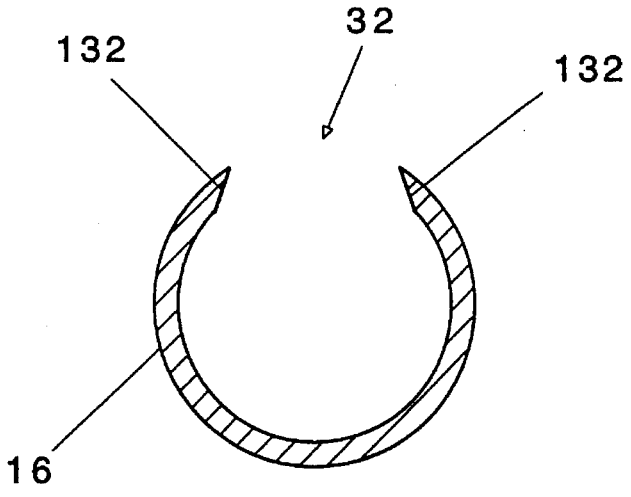
FIG. 14 is a cross-sectional end view of the first supporting member illustrating the tapered sides of the slot.

FIG. 14 illustrates a sixth alternate embodiment, where the slot 32 has tapered sides 132. The tapered sides 132 are wider at the inside diameter, relative to the outside diameter, of the first support member 16. The tapered sides allow for the second support member 18 to more easily slide through slot 32 when the goal structure 1 is being folded or unfolded.

Plastic is the preferred material used to form the posts 6, crossbar member 8, corner joints 10, support members 14, cross-member 24, angled support member 48, T-shaped connectors 50, and telescoping members 52–56. Plastic is especially ideal for forming the first support members 16 because the flexibility of the material forming slot 32 of the first support member 16 allows the second support members 18 to pass therethrough with sufficient friction yet without permanently deforming the slot 32. Further, plastic is durable, lightweight, inexpensive and easy to machine during manufacturing. However, resilient material may be used to form the goal structure 1 without departing from the scope and spirit of the present invention. For example, part or all of the goal structure 1 may be made from metals such as steel, aluminum or carbide.

It is to be understood that the present invention is not limited to the embodiments described above and illustrated herein, but encompasses any and all variations falling within the scope of the appended claims.

What is claimed is:

1. A foldable sports goal structure, comprising:

a U-shaped goal frame including a horizontal crossbar member supported at each end by vertically extending posts having lower ends, the goal frame forming an upright rectangular goal opening when the lower ends of said posts are placed on a playing surface;

a support frame including:

a pair of tubular shaped first support members, each rearwardly extending from the lower ends of each of said posts, each of said first support members having an inner diameter and a rear end, a pair of tubular shaped second support members, each of said second support members having a front end with an outer diameter dimensioned so that each of said front ends is fittable within each of said rear ends, each of said first supporting members having a shaped cut-out in a surface thereof, said cut-out shaped to permit rotation of said second support members from a first position through said shaped cut-out to a second position, wherein in said first position each of said front ends of said second support members being fitted within the inner diameter of each of said rear ends of said first support members and extending rearwardly from said rear ends, and wherein in said second position, said second support members extending substantially perpendicular to said first support members through said shaped cut-outs, and a pair of pivot members each rotatably connecting said first support members to said second support members, and permitting said rotation between said first and second positions; and a net means attached to said goal frame and said support frame.

2. The sports goal structure of claim 1 wherein each of said shaped cut-outs includes a circular aperture formed continuously with a slot that extends to and terminates at said rear end, said slot having a width that is smaller than said outer diameter of said second support member and said circular aperture having a diameter that is substantially equal to said outer diameter of said second support member.

3. The sports goal structure of claim 2 wherein the support frame further comprising:

a cross-member connected between the ends of said second support members that are opposite to said front ends.

4. The sports goal structure of claim 2 wherein said pivot member is a bolt traversing through overlapping holes formed in said first and second support members.

5. The sports goal structure of claim 2 wherein said pivot member is a protrusion formed on the surface of one of said first and second support members that engages a hole formed in the other of said first and second support members.

6. The sports goal structure of claim 2 wherein said pivot member is a spring loaded button biased through overlapping holes formed in said first and second support members.

7. The sports goal structure of claim 2 further comprising:

a spring loaded locking button insertable into holes formed in said first and second support members that overlap only when said second support member is in said first position.

8. The sports goal structure of claim 3 further comprising:

an angled support member removably attached at one end to said crossbar and at the other end to said cross-member.

9. The sports goal structure of claim 3 wherein said crossbar member, said posts and said cross-member are each formed of overlapping telescoping tubular members for changing the height and width of the goal opening defined by the U-shaped goal frame.

10. The sports goal structure of claim 2 wherein said slot having a first width at said circular aperture and a second width at said rear end, said first and second widths not being equal.

11. The sports goal structure of claim 10 wherein said slot has tapered sides.

12. A foldable sports goal structure, comprising:

a U-shaped goal frame including a horizontal crossbar member supported at each end by vertically extending posts having lower ends, the goal frame forming an upright rectangular goal opening when the lower ends of said posts are placed on a playing surface;

a support frame including:

a pair of tubular shaped first support members, each rearwardly extending from the lower ends of each of said posts, each of said first support members having an outer diameter and a rear end, a pair of tubular shaped second support members, each of said second support members having a front end with an inner diameter dimensioned so that each of said rear ends is fittable within each of said front ends, each of said second supporting members having a shaped cut-out in a surface thereof, said cut-out shaped to permit rotation of said first support members from a first position through said shaped cut-out to a second position, wherein in said first position each of said rear ends of said first support members being fitted within the inner diameter of each of said front ends of said second support members and extending forwardly from said front ends, and wherein in said second position, said first support members extending substantially perpendicular to said second support members through said shaped cut-outs, and a pair of pivot members each rotatably connecting said first support members to said second support members, and permitting said rotation between said first and second positions; and a net means attached to said goal frame and said support frame.

13. The sports goal structure of claim 12 wherein each of said shaped cut-outs includes a circular aperture formed continuously with a slot that extends to and terminates at said front end, said slot having a width that is smaller than said outer diameter of said first support member and said circular aperture having a diameter that is substantially equal to said outer diameter of said first support member.

14. The sports goal structure of claim 13 wherein the support frame further comprising:

a cross-member connected between the ends of said second support members that are opposite to said front ends.

15. The sports goal structure of claim 13 wherein said pivot member is a bolt traversing through overlapping holes formed in said first and second support members.

16. The sports goal structure of claim 13 wherein said pivot member is a protrusion formed on the surface of one of said first and second support members that engages a hole formed in the other of said first and second support members.

17. The sports goal structure of claim 13 wherein said pivot member is a spring loaded button biased through overlapping holes formed in said first and second support members.

18. The sports goal structure of claim 13 further comprising:

a spring loaded locking button insertable into holes formed in said first and second support members that overlap only when said first support member is in said first position.

19. The sports goal structure of claim 14 further comprising:

an angled support member removably attached at one end to said crossbar and at the other end to said cross-member.

20. The sports goal structure of claim 14 wherein said crossbar member, said posts and said cross-member are each formed of overlapping telescoping tubular members for changing the height and width of the goal opening defined by the U-shaped goal frame.

21. The sports goal structure of claim 13 wherein said slot having a first width at said circular aperture and a second width at said rear end, said first and second widths not being equal.

22. The sports goal structure of claim 21 wherein said slot has tapered sides.

23. A foldable sports goal structure, comprising:

a U-shaped goal frame including a horizontal crossbar member supported at each end by vertically extending posts having lower ends, the goal frame forming an upright rectangular goal opening when the lower ends of said posts are placed on a playing surface;

a U-shaped support frame including:

a pair of tubular shaped first support members, each rearwardly extending from the lower ends of each of said posts, each of said first support members having an inner diameter and a rear end, a pair of tubular shaped second support members, each of said second support members having a front end with an outer diameter dimensioned so that each of said front ends is fittable within each of said rear ends, a cross-member connected between the ends of said second support members that are opposite to said front ends, each of said first supporting members having a shaped cut-out in a surface thereof, said cut-out shaped to permit rotation of said second support members from a first position through said shaped cut-out to a second position, wherein in said first position each of said front ends of said second support members being fitted within the inner diameter of each of said rear ends of said first support members and extending rearwardly from said rear ends, and wherein in said second position, said second support members extending substantially perpendicular to said first support members through said shaped cut-outs, each of said shaped cut-outs includes a circular aperture formed continuously with a slot that extends to and terminates at said rear end, said slot having a width that is smaller than said outer diameter of said second support member and said circular aperture having a diameter that is substantially equal to said outer diameter of said second support member, and a pair of pivot members each rotatably connecting said first support members to said second support members, and permitting said rotation between said first and second positions;

an angled support member removably attached at one end to said crossbar and at the other end to said cross-member; and a net means attached to said goal frame and said support frame.

24. The sports goal structure of claim 23 further comprising:

a spring loaded locking button insertable into holes formed in said first and second support members that overlap only when said second support member is in said first position.

25. The sports goal structure of claim 23 wherein said crossbar member, said posts and said cross-member are each formed of overlapping telescoping tubular members for changing the height and width of the goal opening defined by the U-shaped goal frame.

26. The sports goal structure of claim 23 wherein said slot having a first width at said circular aperture and a second width at said rear end, said first and second widths not being equal.

27. The sports goal structure of claim 26 wherein said slot has tapered sides.

28. A foldable sports goal structure, comprising:

a U-shaped goal frame including a horizontal crossbar member supported at each end by vertically extending posts having lower ends, the goal frame forming an upright rectangular goal opening when the lower ends of said posts are placed on a playing surface;

a support frame including:

a pair of tubular shaped first support members, each rearwardly extending from the lower ends of each of said posts, each of said first support members having an inner diameter and a rear end, a tubularly shaped beam having a pair of second support member portions, each of said second support member portions having a front end with an outer diameter dimensioned so that each of said front ends is fittable within each of said rear ends, each of said first supporting members having a shaped cut-out in a surface thereof, said cut-out shaped to permit rotation of said second support member portions from a first position through said shaped cut-out to a second position, wherein in said first position each of said front ends of said second support member portions being fitted within the inner diameter of each of said rear ends of said first support members and extending rearwardly from said rear ends, and wherein in said second position, said second support member portions extending substantially perpendicular to said first support members through said shaped cut-outs, and a pair of pivot members each rotatably connecting said first support members to said second support member portions, and permitting said rotation between said first and second positions; and a net means attached to said goal frame and said support frame.

29. The sports goal structure of claim 28 wherein each of said shaped cut-outs includes a circular aperture formed continuously with a slot that extends to and terminates at said rear end, said slot having a width that is smaller than said outer diameter of said second support member portion and said circular aperture having a diameter that is substantially equal to said outer diameter of said second support member portion.

30. The sports goal structure of claim 29 further comprising:

a spring loaded locking button insertable into holes formed in said first support member and said second support member portion that overlap only when said second support member portion is in said first position.

31. The sports goal structure of claim 29 further comprising:

an angled support member removably attached at one end to said crossbar and at the other end to said beam.

32. The sports goal structure of claim 29 wherein said slot having a first width at said circular aperture and a second width at said rear end, said first and second widths not being equal.

* * * * *